US008403688B2

(12) United States Patent
Li et al.

(10) Patent No.: US 8,403,688 B2
(45) Date of Patent: Mar. 26, 2013

(54) ELECTRONIC DEVICE FOR RECEIVING USB DEVICE

(75) Inventors: Tsung-Hsi Li, New Taipei (TW); Ming-Chih Hsieh, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 104 days.

(21) Appl. No.: 13/191,455

(22) Filed: Jul. 27, 2011

(65) Prior Publication Data

US 2012/0244731 A1 Sep. 27, 2012

(30) Foreign Application Priority Data

Mar. 21, 2011 (TW) ..... 100109610

(51) Int. Cl.
*H01R 13/62* (2006.01)

(52) U.S. Cl. ..... 439/152

(58) Field of Classification Search ..... 439/152, 439/357, 640, 446, 165, 32, 352–353
See application file for complete search history.

(56) References Cited

U.S. PATENT DOCUMENTS

| | | | | |
|---|---|---|---|---|
| 7,632,113 | B2 * | 12/2009 | Finn | 439/131 |
| 7,670,190 | B2 * | 3/2010 | Shi et al. | 439/640 |
| 8,189,101 | B2 * | 5/2012 | Cummings et al. | 348/376 |
| 2006/0131431 | A1 * | 6/2006 | Finn | 235/492 |
| 2011/0007468 | A1 * | 1/2011 | Burton et al. | 361/679.03 |

* cited by examiner

*Primary Examiner* — Jean F Duverne
(74) *Attorney, Agent, or Firm* — Altis Law Group, Inc.

(57) ABSTRACT

An electronic device includes an enclosure, and an operation device. The enclosure includes a first sidewall, and a second sidewall connected to a rear end of the first sidewall. A receiving recess is defined in the first sidewall and extends through the second sidewall, to receive a universal serial bus (USB) device. A USB port is installed in receiving recess away from the second sidewall, to be connected to the USB device. The operation device is pivotably connected to the receiving recess and includes two spaced arms to sandwich the USB device when the USB device is connected to the USB port. When the operation device is rotated in a predetermined direction, the arms move toward the second sidewall, to push the connected USB device to disengage from the USB port.

10 Claims, 3 Drawing Sheets

ELECTRONIC DEVICE FOR RECEIVING USB DEVICE

BACKGROUND

1. Technical Field

The present disclosure relates to an electronic device for receiving a universal serial bus (USB) device.

2. Description of Related Art

Typically, a universal serial bus (USB) port is mounted on a sidewall of an electronic device, to connect a USB device to the electronic device. However, because most parts of the USB device are exposed out of the electronic device, the USB device is easily loosened or broken when struck.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawing, all the views are schematic, and like reference numerals designate corresponding parts throughout the several views.

DETAILED DESCRIPTION

The disclosure, including the accompanying drawings, is illustrated by way of example and not by way of limitation. It should be noted that references to "an" or "one" embodiment in this disclosure are not necessarily to the same embodiment, and such references mean at least one.

Figure 1:
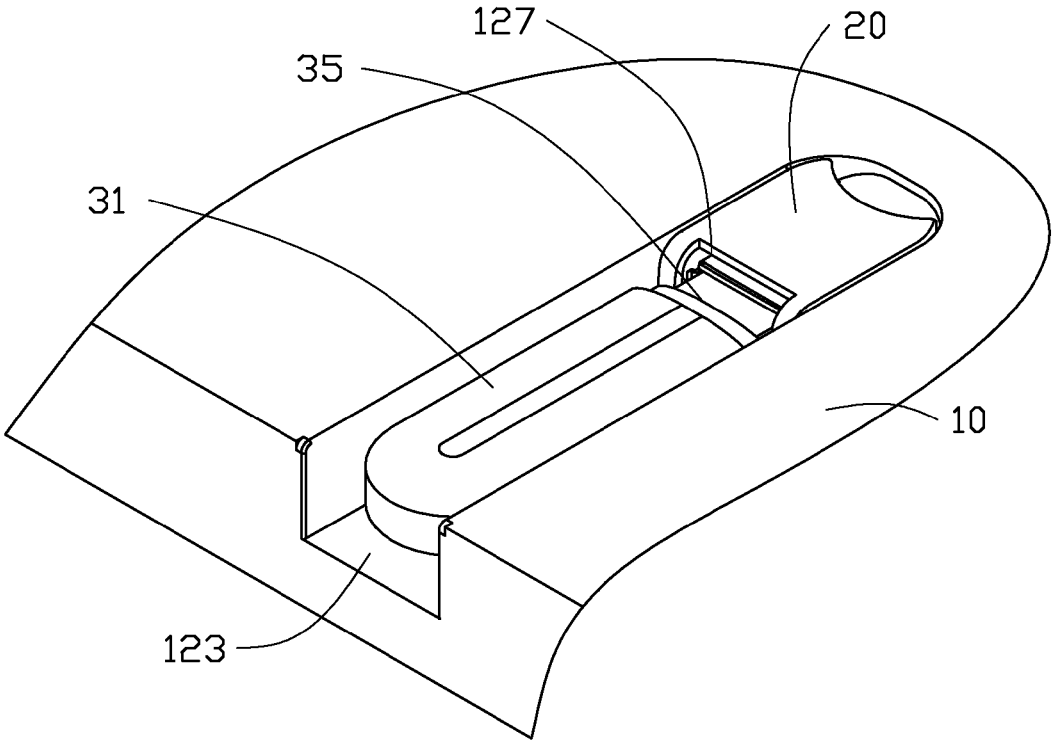
FIG. 1 is an assembled, isometric view of an embodiment of an electronic device together with a universal serial bus (USB) device connected thereto.
Figure 2:
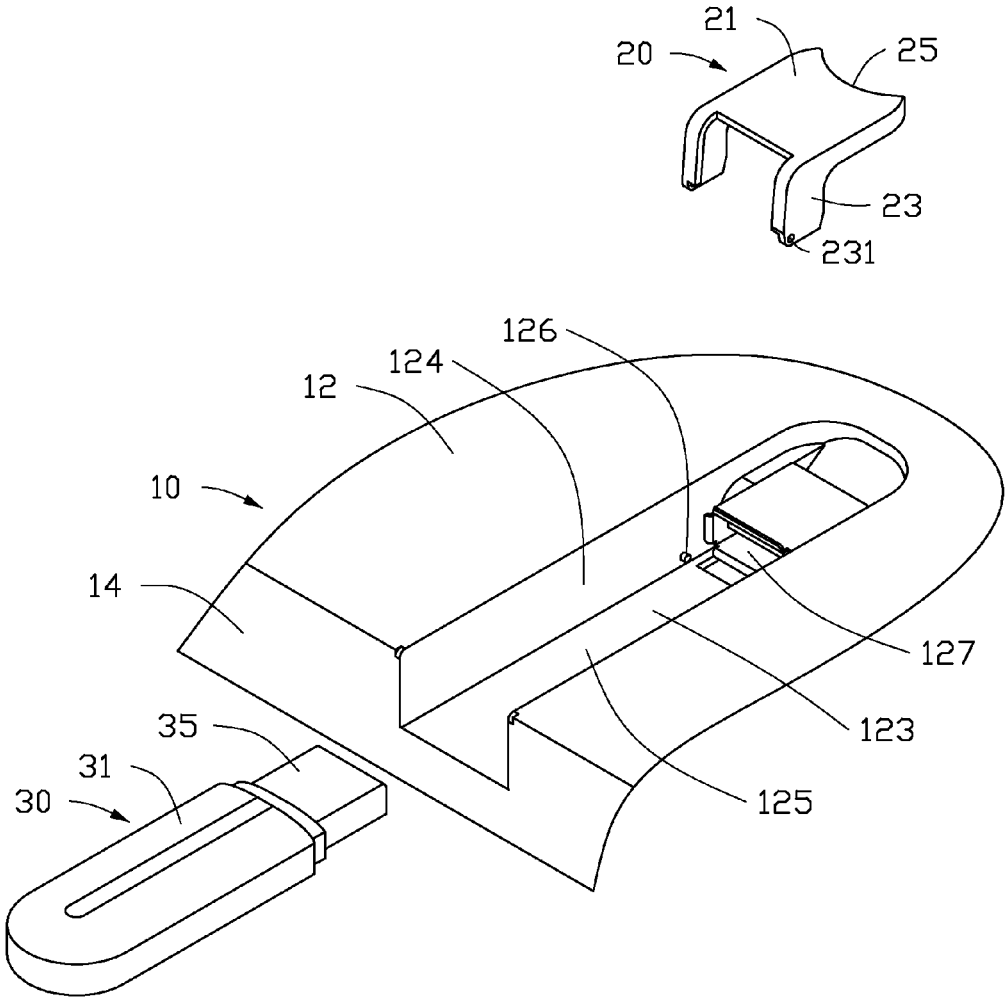
FIG. 2 is an exploded, isometric view of FIG. 1.

Referring to FIGS. 1 and 2, an embodiment of an electronic device is provided to receive and connect a universal serial bus (USB) device 30, such as a USB flash drive, or a USB network adapter. The electronic device includes an enclosure 10, and an operation device 20.

The USB device 30 includes a main body 31, and a connector 35 protruding out from a middle portion of a front end of the main body 31.

The enclosure 10 includes a first sidewall 12, and a second sidewall 14 perpendicularly extending down from a rear end of the first sidewall 12. A concave receiving recess 123 is defined in the first sidewall 12, with an end of the receiving recess 123 extending through the second sidewall 14. The receiving recess 123 includes two opposite inner walls 124, and a bottom wall 125 connected between bottoms of the inner walls 124 and parallel to the first sidewall 12. A USB port 127 is installed in receiving recess 123, away from the second sidewall 14. A pivot 126 perpendicularly extends from each inner wall 124, adjacent to the bottom wall 125 behind the USB port 127.

The operation device 20 includes a plate 21, and two substantially L-shaped arms 23 extending down from rear ends of opposite sides of the plate 21. A pivot hole 231 is defined in a rear corner of each arm 23. A notch 25 is defined in a front end of the plate 21.

In assembly, the plate 21 is placed on the USB port 127. The arms 23 are pressed toward each other and inserted into the receiving recess 123, to allow the pivot holes 231 to align with the pivots 126, respectively. The arms 23 are released and restored to allow the pivots 126 to engage in the corresponding pivot holes 231. Thereby, the operation device 20 is rotatably connected in the receiving recess 123 of the enclosure 10.

To connect the USB device 30 to the electronic device, the USB device 30 is inserted into the receiving recess 123 and moved towards the USB port 127, until the connector 35 is completely plugged into the USB port 127. The connector 35 is sandwiched between the arms 23 of the operation device 20, and the front end of the main body 31 aligns with the arms 23. The main body 31 is completely received in the receiving recess 123, thereby the USB device 30 is protected from being struck.

Figure 3:
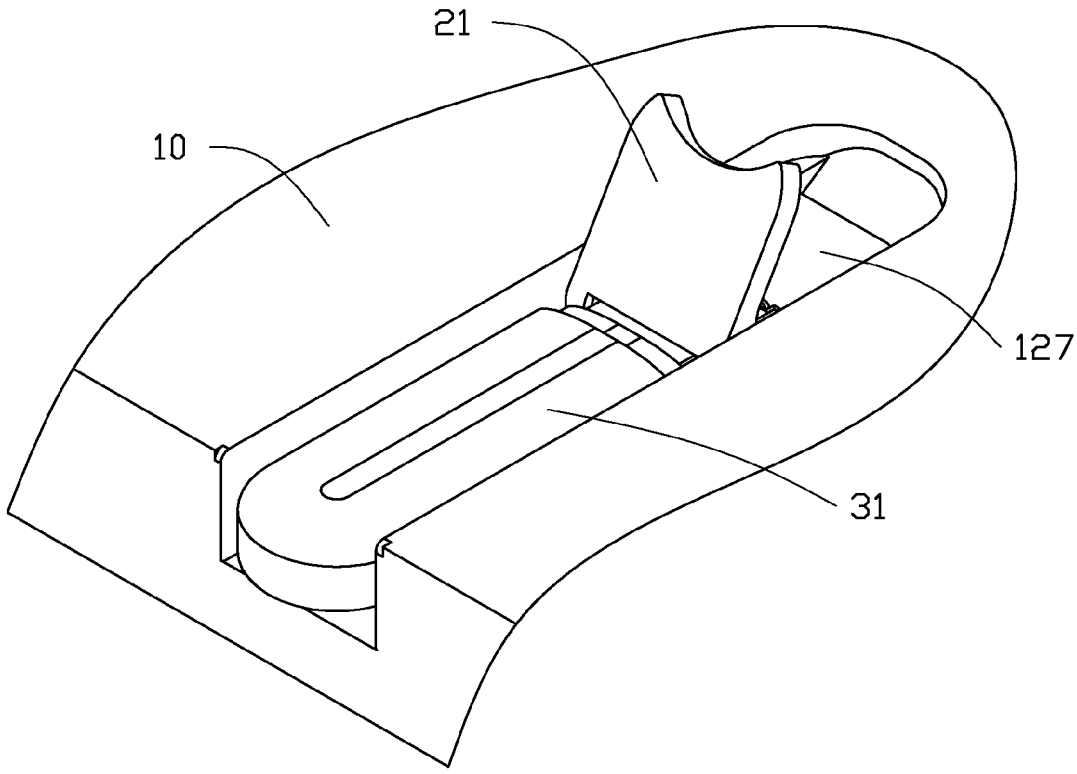
FIG. 3 is similar to FIG. 1, but the USB device is disengaged from the electronic device.

Referring to FIG. 3, to detach the USB device 30 from the electronic device, an operator inserts a finger into the notch 25 and rotates the operation device 20 back. The arms 23 push the front end of the main body 31 backwards, until a rear end of the main body 31 is exposed out of the receiving recess 123. The USB device 30 can be easily detached from the electronic device by pulling the rear end of the main body 31 backwards.

Even though numerous characteristics and advantages of the embodiments have been set forth in the foregoing description, together with details of the structure and the functions of the embodiments, the disclosure is illustrative only, and changes may be made in details, especially in matters of shape, size, and arrangement of parts within the principles of the embodiments to the full extent indicated by the broad general meaning of the terms in which the appended claims are expressed.

What is claimed is:

1. An electronic device to receive a universal serial bus (USB) device, the electronic device comprising:

an enclosure comprising a first sidewall, and a second sidewall connected to a rear end of the first sidewall, a receiving recess defined in the first sidewall to receive the USB device, a rear end of the receiving recess extending through the second sidewall, a USB port installed in receiving recess away from the second sidewall to be connected to the USB device; and an operation device pivotably connected in the receiving recess and comprising two spaced arms to sandwich the USB device when the USB device is connected to the USB port, wherein when the operation device is rotated in a predetermined direction, the arms move toward the second sidewall, to push the connected USB device to disengage from the USB port.

2. The electronic device of claim 1, wherein the receiving recess comprises two opposite inner walls, opposite sides of the operation device are pivotably connected to the inner walls, respectively.

3. The electronic device of claim 2, wherein the operation device further comprises a plate located on the USB port, the arms are substantially L-shaped and respectively extend down from rear ends of opposite sides of the plate.

4. The electronic device of claim 3, wherein the receiving recess further comprises a bottom wall connected between bottoms of the inner walls and parallel to the first sidewall, a pivot protrudes from each inner wall adjacent to the bottom wall behind the USB port, and a pivot hole is defined in a rear corner of each arm, to receive the corresponding pivot.

5. The electronic device of claim 3, wherein a notch is defined in a front end of the plate.

6. An electronic device to receive a universal serial bus (USB) device, the electronic device comprising:

an exterior surface defining a recess for receiving the USB device;

a USB port installed on a side of the recess to connect with the USB device; and an operation device pivotably mounted in the recess and comprising two spaced arms, wherein the space between the two arms allows portion of the USB device to pass through when connecting to the USB port, and wherein when the operation device is rotated in a predetermined direction, the two arms push the connected USB device to disengage from the USB port.

7. The electronic device of claim 6, wherein the recess comprises two opposite inner walls, opposite sides of the operation device are pivotably connected to the inner walls, respectively.

8. The electronic device of claim 7, wherein the operation device further comprises a plate located on the USB port, the arms are substantially L-shaped and respectively extend down from ends of opposite sides of the plate.

9. The electronic device of claim 8, wherein the recess further comprises a bottom wall connected between bottoms of the inner walls and parallel to the exterior surface, a pivot protrudes from each inner wall adjacent to the USB port, and a pivot hole is defined in a corner of each arm, to receive the corresponding pivot.

10. The electronic device of claim 8, wherein a notch is defined in an end of the plate opposite to the arms.

* * * * *